US008215322B2

(12) United States Patent
Fountain et al.

(10) Patent No.: US 8,215,322 B2
(45) Date of Patent: Jul. 10, 2012

(54) DISHWASHER WITH SOIL REMOVAL

(75) Inventors: Jordan Robert Fountain, Saint Joseph, MI (US); Dennis L. Kehl, Benton Harbor, MI (US); James P. Tomey, Simpsonville, SC (US); Rodney M. Welch, Beech Bluff, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 716 days.

(21) Appl. No.: 12/340,852

(22) Filed: Dec. 22, 2008

(65) Prior Publication Data

US 2010/0154841 A1 Jun. 24, 2010

(51) Int. Cl.
*B08B 3/04* (2006.01)
*B08B 3/00* (2006.01)

(52) U.S. Cl. ..... 134/104.4; 134/56 D; 134/57 D; 134/58 D; 134/104.2

(58) Field of Classification Search ..... 134/104.2, 134/104.4, 56 D, 57 D, 58 D
See application file for complete search history.

(56) References Cited

U.S. PATENT DOCUMENTS

| | | | | |
|---|---|---|---|---|
| 2,854,141 | A | 9/1958 | Barnstead | |
| 3,575,185 | A | 4/1971 | Barbulesco | |
| 3,957,636 | A | 5/1976 | Arvanitakis | |
| 4,192,749 | A * | 3/1980 | Jackson | 210/107 |
| 4,410,433 | A | 10/1983 | Arvanitakis | |
| 5,711,325 | A | 1/1998 | Kloss et al. | |
| 6,079,427 | A * | 6/2000 | Perry, Jr. | 134/104.4 |
| 6,234,184 | B1 | 5/2001 | Tuller et al. | |
| 6,782,899 | B2 | 8/2004 | Kim et al. | |
| 2006/0237048 | A1 | 10/2006 | Weaver et al. | |
| 2008/0116135 | A1 * | 5/2008 | Rieger et al. | 210/650 |

FOREIGN PATENT DOCUMENTS

| | | | |
|---|---|---|---|
| DE | 2254542 | | 5/1974 |
| DE | 2508302 | B * | 4/1976 |
| DE | 4131914 | A1 | 4/1993 |
| EP | 0748607 | A2 | 12/1996 |
| EP | 752231 | A1 * | 1/1997 |
| EP | 1386575 | A1 * | 2/2004 |
| GB | 1348364 | | 3/1974 |
| GB | 1584195 | | 2/1981 |
| GB | 2204482 | A | 11/1988 |
| GB | 2254542 | A | 10/1992 |
| WO | 2006/063894 | A1 | 6/2006 |

OTHER PUBLICATIONS

DE 2508302 Machine Translation Apr. 1976 Germany.*

* cited by examiner

*Primary Examiner* — Michael Barr
*Assistant Examiner* — Charles W Kling
(74) *Attorney, Agent, or Firm* — Robert A. Bacon; McGarry Bair PC

(57) ABSTRACT

The invention relates to a dishwasher comprising a tub in which utensils and the like are received for cleaning by the spraying of liquid, such as a wash liquid, within the tub, with a sequester located within the tub to sequester the particles removed from the utensils by the liquid and that remain in the tub near a drain outlet.

9 Claims, 6 Drawing Sheets

DISHWASHER WITH SOIL REMOVAL

BACKGROUND OF THE INVENTION

In a conventional dishwasher, liquid is sprayed onto the wash load in the wash chamber to remove soil from the utensils placed in the dishwasher. The liquid and soil removed from the utensils accumulates in the sump of the dishwasher where they can be removed from the sump through a drain. To minimize water consumption, many dishwashers further comprise a circulation circuit that reuses water that accumulates in the sump to clean the utensils placed in the dishwasher.

Typically, a filter will be located in or near the sump to filter or partially filter the liquid before it is circulated back to the wash chamber. The filters used to filter the liquid to be circulated often become clogged or blocked with filtered soil that may accumulate over time or soil that does not drain completely from the sump.

SUMMARY OF THE INVENTION

In one embodiment, the invention relates to a dishwasher comprising a tub that defines a wash chamber for washing utensils placed within the wash chamber. The dishwasher further comprises a sump that is fluidly coupled with a drain circuit to drain liquid from the sump and a circulation circuit for circulating liquid from the sump to the wash chamber. A filter may be located within the sump to separate the circulation circuit from the drain circuit such that liquid passing from the sump to the circulation circuit passes through the filter and particles present in the liquid that are too large to pass through the filter remain in the sump. A sequester is located within the sump to sequester the particles that remain in the sump near a drain outlet that is fluidly connected with the drain circuit.

According to another embodiment, the invention comprises a tub defining a wash chamber for receiving utensils to be washed, a circulation circuit and a drain circuit. The circulation circuit is fluidly couples the sump to the wash chamber to circulate liquid from the sump to the wash chamber; the drain circuit has an inlet fluidly coupled with the sump to drain liquid. The dishwasher also comprises a filter assembly having a housing that fluidly couples the circulation circuit and the drain circuit to the tub. A filter located within the housing has multiple channels separated by interstitial spaces in communication with the drain inlet; each channel has an open portion in communication with the circulation circuit.

According to yet another embodiment, the invention comprises a tub defining a wash chamber for receiving utensils to be washed, a circulation circuit and a drain circuit. The dishwasher also comprises a filter assembly having a housing that fluidly couples the circulation circuit and the drain circuit to the tub. A filter located within the housing has multiple channels separated by interstitial spaces in communication with the drain inlet; each channel has an open portion in communication with the circulation circuit. The filter assembly further comprises a sequester located within the housing to sequester particles entrained in the liquid near the drain inlet.

DESCRIPTION OF EMBODIMENTS OF THE INVENTION

Figure 1:
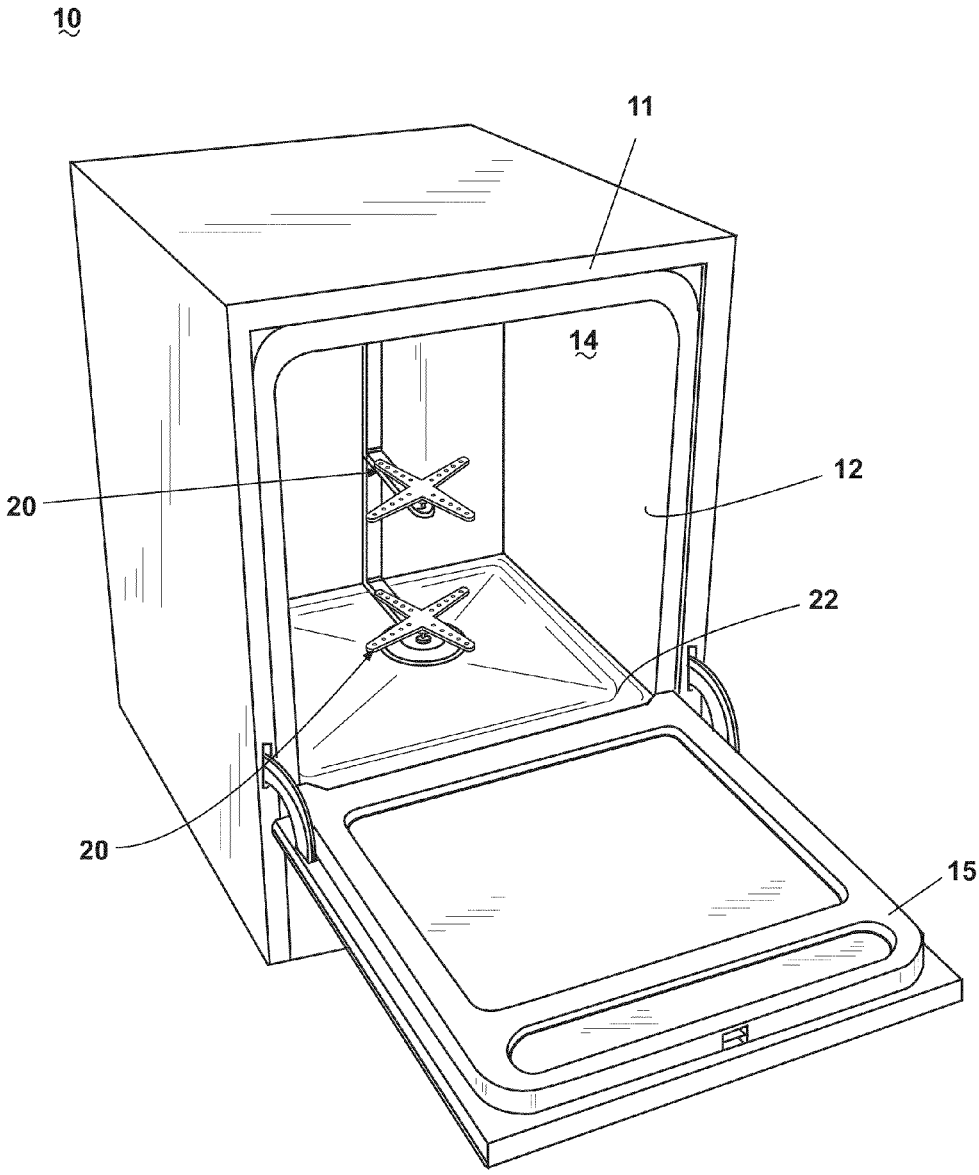
FIG. 1 illustrates a dishwasher suitable for use with the invention according to an embodiment of the invention.
Figure 2:
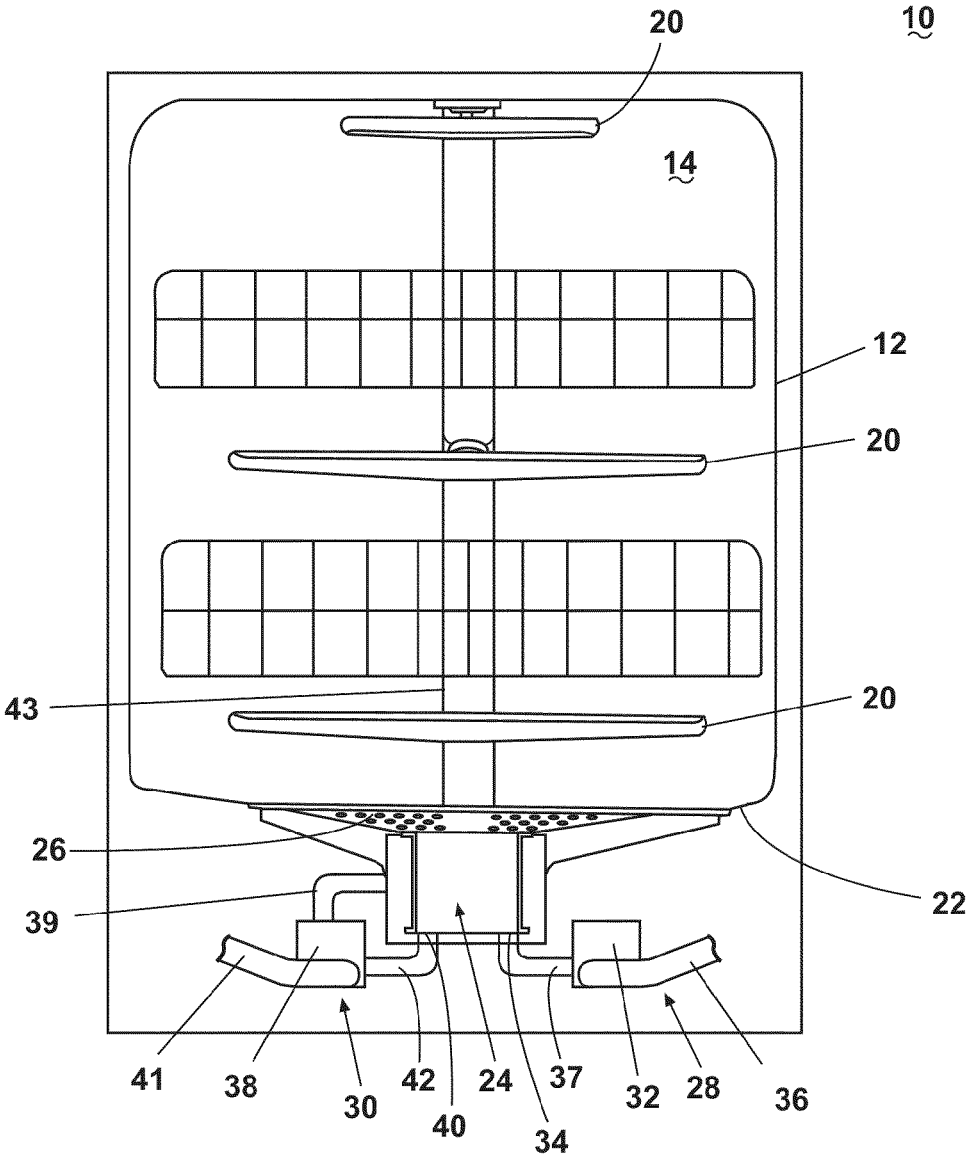
FIG. 2 is a schematic of a dishwasher according to an embodiment of the invention.

Referring now to the figures, FIG. 1 illustrates a dishwasher 10 according to one embodiment of the invention. The dishwasher 10 comprises cabinet 11 in which is provided a tub 12 defining a wash chamber 14 in which utensils are received for washing. A door 15 may be provided for selective access to the wash chamber 14. The wash chamber 14 may comprise one or more sprayers 20 from which liquid may be sprayed for washing utensils placed within the wash chamber 14. The sprayers 20, while illustrated as rotating arms, may be fixed and may have a configuration other than an arm. As best seen in FIG. 2, the bottom 22 of the tub 12 may slope towards a sump 24 that may be covered by a grating 26.

The dishwasher 10 may further comprise a drain circuit 28 and a circulation circuit 30. The drain circuit 28 may be fluidly connected with the sump 24 to drain liquid and soil that collect in the sump 24 through one or more drain inlets 34 located at the bottom of the sump 24. The drain circuit 28 may further comprise a drain pump 32 fluidly coupling the drain inlets 34 to a drain hose 36, which is fluidly coupled to a household drain (not shown). In this manner, the drain pump 32 may be actuated to draw liquid and soils from the sump 24 and direct them to the household drain. The drain inlets 34 may be fluidly connected with the drain pump 32 by a manifold assembly, for example, or the fluid inlets 34 may each by directly connected with the drain pump 32 through a hose 37. In some configurations, the inlet to the drain pump 32 may also form the drain inlets 34.

The circulation circuit 30 may be fluidly coupled with the sump 24 and the wash chamber 14 to circulate liquid from the sump 24 to the wash chamber 14 through one or more circulation inlets 40 located at the bottom of the sump 24. The circulation circuit 30 may further comprise a circulation pump 38 fluidly coupling with the circulation inlets 40 to circulate liquid from the sump 24 to the wash chamber 14. The circulation inlets 40 may be fluidly connected the circulation pump 38 by a manifold assembly, for example, or the circulation inlets 40 may each be directly connected with the circulation pump 38 through a hose 42.

The circulation circuit 30 may also comprise a first supply hose 39 and a second supply hose 41 for delivering liquid to the one or more sprayers 20. The first supply hose 39 may fluidly couple the circulation pump 38 with the sprayer 20 located at the bottom of the wash chamber 14. The second supply tube 41 may fluidly couple the circulation pump with a supply conduit 43 that extends upwards along a sidewall of the wash chamber 14. The supply conduit 43 may be fluidly connected with one or more mid-level and upper-level sprayers 20 located within the wash chamber 14. In this manner, the circulation pump 38 can be actuated to draw liquid from the sump 24 and direct it to the wash chamber 14 through the sprayers 20.

While the circulation circuit 30 is illustrated with three sprayers, it is within the scope of the invention for the circulation circuit 30 to comprise any number of sprayers. In addition, the circulation circuit 30 may also include one or more sprayers, jets or nozzles located anywhere within the wash chamber 14.

Figure 3:
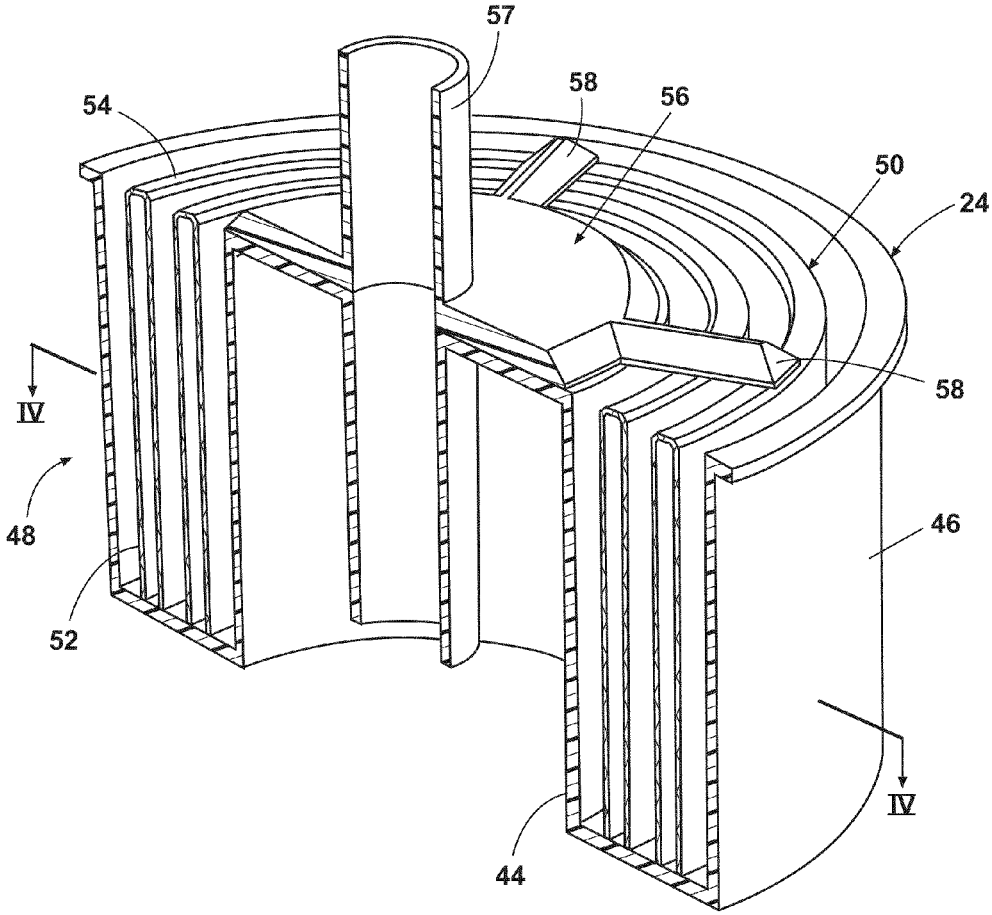
FIG. 3 is a cross-section of a sump having a filter assembly according to an embodiment of the invention.

As illustrated in FIG. 3, the sump 24 may be in the form of an annular cylinder comprising an inner wall 44 and an outer wall 46. A filter assembly 48 comprising one or more cylindrical filter elements 50 may be concentrically disposed within the sump 24 between the inner and outer walls 44, 46. The filter elements 50 separate the drain inlets 34 (FIGS. 2 and 4) from the circulation inlets 40 such that liquid that enters the sump 24 may pass through the filter elements 50 before entering the circulation inlets 40.

The filter element 50 may have a generally inverted "U"-shaped cross-section with the open top of the "U" located near the base of the sump 24 and the base of the "U" located near the top of the sump 24. The filter element 50 may comprise a pair of cylindrical filter screens 52 extending from the bottom of the sump 24 to the top. The filter screens 52 may be connected near the top of the sump 24 at the base of the "U" by a connector member 54. The bottom of the filter element 50 may be positioned at the bottom of the sump 24 such that little or no liquid can pass through the filter element 50 through any path other than through the filter screen 52.

The connector member 54 may be integral with the filter screens 52 or be made from a different material, such as plastic or metal. For example, the filter element 50 may comprise a single filter screen formed in the shape of a U. In another example, the filter element may comprise two separate filter screens 52 connected at the base of the "U" by a connector member 54. The connector member 54 may be a solid element made from metal or plastic, or may comprise a mesh or sieve-like structure.

The filter screens 52 may be made from any suitable material and have any suitable pore size. One example of a suitable material is stainless steel. One or more filter screens 52 may be made from a stainless steel mesh screen having a pore size of approximately 200 μm, for example. The filter assembly 48 may also comprise multiple filter elements 50 comprising filter screens 52 with different pore sizes. Each filter element 50 may also comprise multiple filter screens 52 having the same or different pore size. The pore size is normally selected based on the anticipated particle size to be filtered from the liquid.

While the filter assembly 48 is illustrated comprising two, concentrically arranged filter elements 50, the invention is not limited by the number of the filter elements 50. Although not illustrated, it is also within the scope of the invention for the filter assembly 48 to comprise one or more internal support structures that may be associated with the filter screens 52 to provide resiliency to external forces such as the flow of soil and liquid and other elements of the filter assembly 48, for example.

The filter assembly 48 may also comprise a rotor 56 rotatably connected with the filter elements 50 by one or more arms 58. Rotation of the arms 58 induces rotation of the filter elements 50 within the sump 24. The rotor 56 may have a shaft 57 that is rotated by any suitable mechanism. For example, the shaft 57 may be connected to the sprayer 20, which rotates, and the rotation of the sprayer 20 rotates the shaft 57. Another suitable mechanism would include a motor for rotating the shaft 57.

For purposes of the invention, relative rotation of the rotor 56 and the sump 24 is desired. While the relative rotation has been described in terms of the rotor 56 rotation relative to the sump 24, it with in the scope of the invention for both the rotor 56 and sump 24 to rotate at different speeds and/or in counter directions. It is also within the scope of the invention for sump 24 to rotate while the filter assembly 48 is fixed. In this implementation, the sump 24 is provided with a shaft 57 that is coupled to a suitable drive mechanism.

Figure 4:
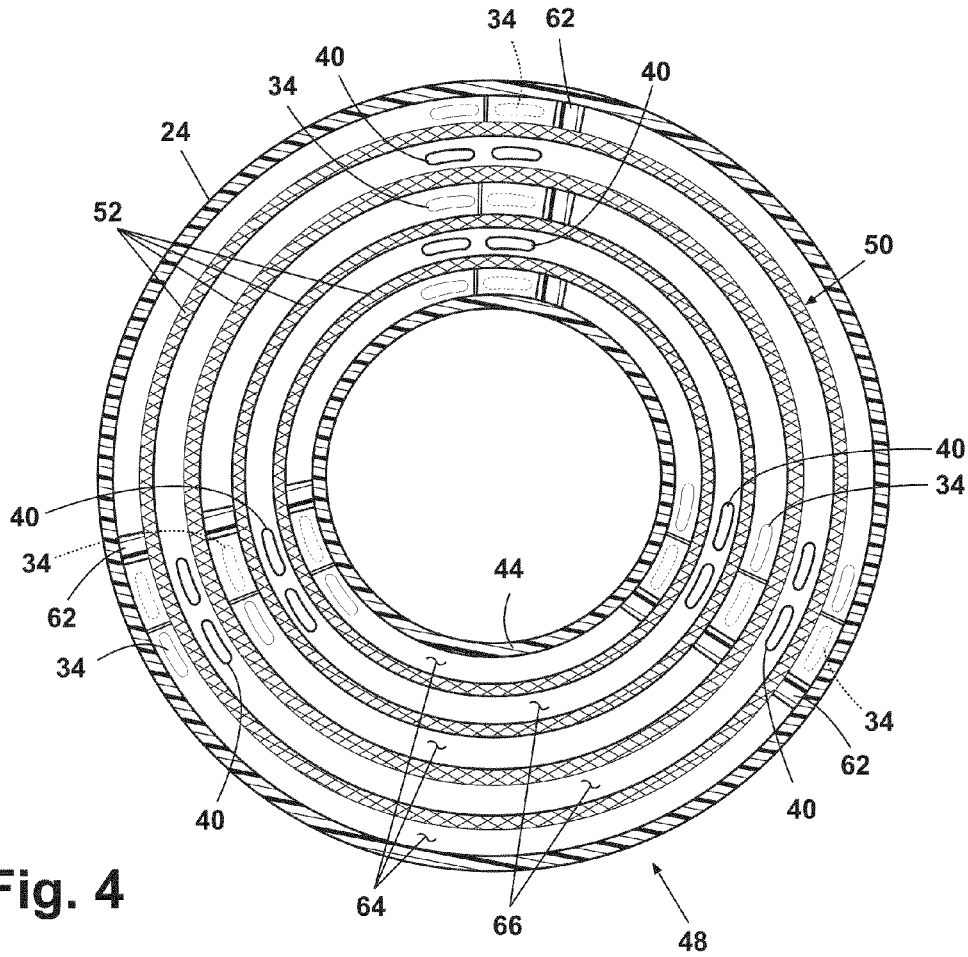
FIG. 4 is a top-down view of a section of the sump and filter assembly illustrated in FIG. 3 along the line IV-IV according to an embodiment of the invention.
Figure 5:
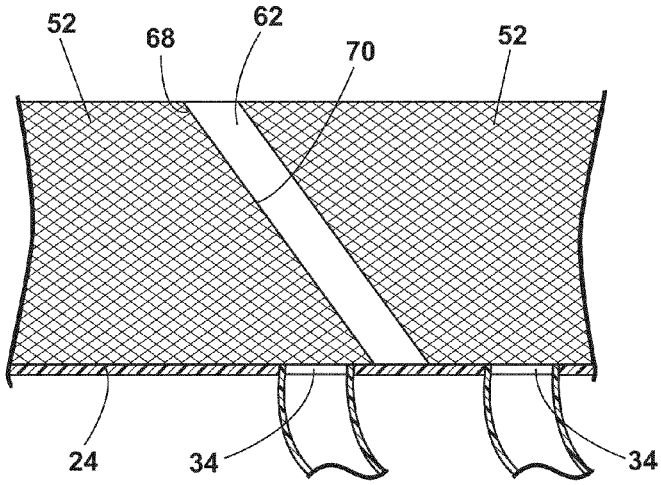
FIG. 5 is side view of a deflector associated with the sump and filter assembly illustrated in FIG. 2 according to an embodiment of the invention.

As illustrated in FIGS. 4 and 5 the filter assembly 48 may also comprise one or more drain channels 64 separating one or more circulation channels 66 concentrically arranged within the sump 24. The circulation channels 66 may be defined by the inverted "U"-shaped filter element 50 having a pair of filter screens 52 connected at the base of the "U" by the connector member 54 near the top of the sump 24 and connected with the base of the sump 24 at the open end of the "U". The filter element 50 can be connected with the base of the sump 24 by a weld or caulk line, for example. Alternatively, the filter element 50 can simply rest on the base of the sump 24.

Each drain channel 64 may be fluidly connected with the drain circuit 28 through at least one drain inlet 34 for draining liquid and soil from the sump 24 to the household drain. In this manner, actuation of the drain pump 32 may draw liquid and soil that enters the sump 24 and is deposited within a drain channel 64 into the drain hose 36 which is fluidly coupled to the household drain.

Each circulation channel 66 may be fluidly connected with the circulation circuit 30 through at least one circulation inlet 40 for circulating liquid that enters the sump 24 and passes through the filter screens 52 to the wash chamber 14. In this manner, actuation of the circulation pump 38 may draw liquid that has entered the sump 24 and been filtered through the filter screens 52 into at least one of the first and second supply hoses 39, 41 for supplying the sprayers 20 with filtered liquid.

At least one sequester in the shape of a deflector 62 is disposed within each drain channel 64 adjacent the drain inlet 34. The deflector 62 may be disposed within the sump 24 adjacent the filter elements 50 for removing accumulated soil from the filter elements 50. The deflectors 62 may extend from the top of the filter assembly 48 to the bottom of the sump 24 and may be in a generally vertical or angled position within the sump 24. The deflectors 62 are located adjacent the filter elements 50 such that at least one side of the deflector 62 is in contact with the adjacent filter screen 52.

The portion of the deflectors 62 which contact the filter screens 52 may be made from any suitable material, such as silicone, for example. The deflectors 62 may be made entirely from silicone or they may be made from more than one material, wherein at least the parts that contact the filter screens 52 are made from a compliant material.

As illustrated in FIG. 5, the deflector 62 may be angled upwards from the base of the sump 24 and over the drain inlets 34 such that the deflector 62 comprises a leading top portion 68 and a leading edge 70. The filter screen 52 may be rotated relative to the deflector 62 in a direction such that any soil accumulated on the surface of the filter screen 52 contacts the leading edge 70 of the deflector 62. As the filter screen 52 is rotated past the deflector 62, the soil will be removed from the filter screen 52 and accumulate on the leading edge 70 of the deflector 62. As the soil is removed from the filter screen 52 it will be driven down the leading edge 70 of the deflector 62 towards the drain inlet 34. The deflector 62 also provides a sequestration feature to hold the soil near the drain inlet 34 until it can be removed from the sump 24 by the drain circuit 28 during a drain cycle.

The deflectors 62 may be stationary within the sump 24, while the filter elements 50 are rotatably disposed within the sump housing, as illustrated in FIGS. 3 and 4. As illustrated, the deflectors 62 may be integrally formed with the sump 24.

The deflectors 62, the drain inlets 34 and the circulation inlets 40 may be arranged in parallel, as illustrated, or they may be arranged in a staggered or random pattern. The number of the deflectors 62, the drain inlets 34 and the circulation inlets 40 located within or connected with the sump 24 is not limited to that illustrated in the figures, but may be any suitable number During the course of a wash or rinse cycle, liquid and soil drains towards the bottom 22 of the tub 12 and may enter the sump 24 through the grating 26. Liquid may be drawn into the circulation circuit 30 from the circulation channels 66 through the circulation inlets 40. Soil may be drawn into the drain circuit 28 from the drain channels 64 through the drain inlets 34.

As liquid entering the sump 24 is drawn into the circulation channel 66 through the filter screens 52, soil present in the liquid that is larger than the pore size of the filter screen 52 is removed from the liquid. The circulation pump 38 provides suction at the circulation inlets 40 that provides a force to drive liquid and soil against the filter screen 52 and into the circulation channels 66. The movement of liquid and soil through the filter assembly 48 provides filtered water to the circulation circuit 30, which may supply filtered water to the sprayers 20 for spraying articles placed in the wash chamber 14.

As the soil is filtered from the liquid by the filter screens 52, the soil may accumulate on the surface of the filter screens 52, which may decrease the efficiency of the filter assembly 48 and the circulation circuit 30. The deflectors 62 may remove accumulated soil from the filter screens 52 as they are rotated relative to the deflectors 62 and direct the soil to the drain inlets 34. In this manner, soil that may accumulate on the filter screens 52 may be removed and withdrawn from the sump 24 through the drain circuit 28 by actuation of the drain pump 32.

Figure 6:
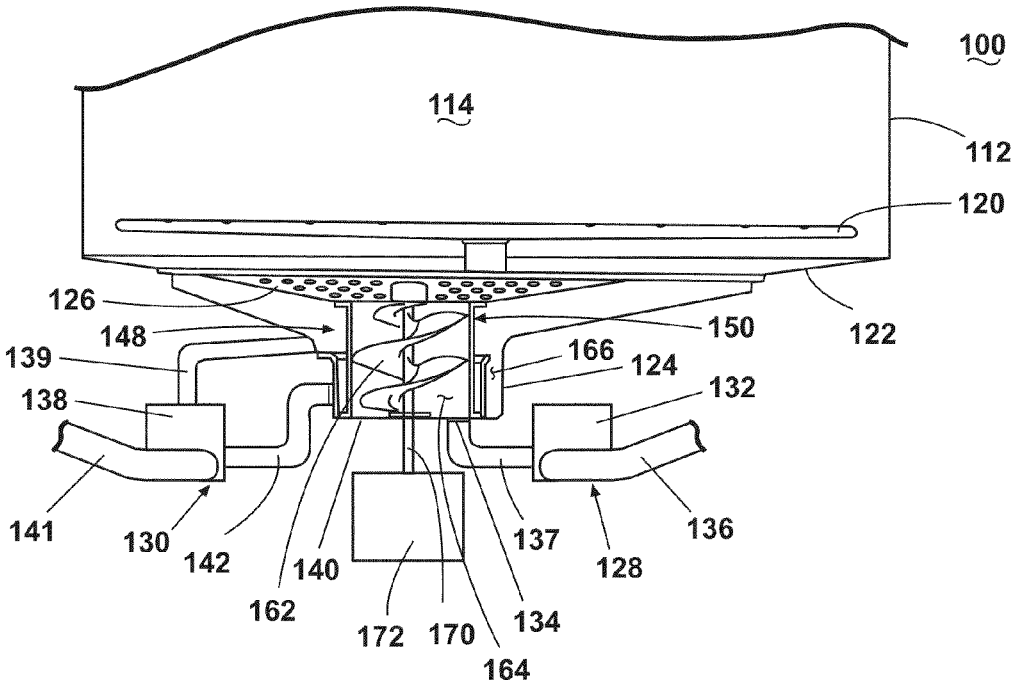
FIG. 6 is schematic of a dishwasher having a filter assembly comprising an auger according to an embodiment of the invention.

FIG. 6 illustrates a dishwasher 100 according to another embodiment of the invention. The dishwasher 100 is similar to the dishwasher 10, therefore elements in the dishwasher 100 similar to those of dishwasher 100 will be numbered with the prefix 100.

As illustrated in FIG. 5, the dishwasher 100 comprises a tub 112 defining a wash chamber 114. The bottom 122 of the tub 112 may slope downwards towards a sump 124. The sump 124 may be covered by a grating 126.

The sump 124 may be fluidly connected with a drain circuit 128 for draining soil and liquid from the sump 124 and a circulation circuit 130 for circulating liquid from the sump 124 back to the wash chamber 114. The drain circuit 128 may comprise a drain inlet 134 fluidly connected with a drain hose 136 by a drain pump 132. When actuated, the drain pump 132 may draw soil and liquid from the sump 124 and into the drain hose 136 which may be fluidly coupled with a household drain (not shown).

The circulation circuit 130 may comprise a circulation inlet 140 fluidly connected with a first and second supply hose 139, 141 by a circulation pump 138. The first supply hose 139 may be connected with a lower sprayer at the bottom of the tub 112 for spraying water into the wash chamber 114. The second supply hose 141 may be fluidly coupled with one or more additional sprayers 120 located in the middle or at the top of the wash chamber 114 through a supply conduit that may extend up a side wall of the tub 112 (not shown). In this manner, the circulation pump 138 may be actuated to draw liquid from the sump 124 and supply it to the wash chamber 114 through one or more sprayers 120.

A filter assembly 148 comprising a cylindrical filter element 150 is located within the sump 124. The cylindrical filter element 150 extends from the bottom of the sump 124 to the grating 126 and separates the drain inlet 134 from the circulation inlet 140 in such a way that liquid entering the sump 124 from the wash chamber 114 is filtered by the filtering element 150 before it enters the circulation inlet 140. The side walls of the filter element 150 may comprise one or more filter screens 152. The filter screen 152 may be made from any suitable material and have any suitable pore size. One example of a suitable material is stainless steel. Each filter element 150 may also comprise multiple filter screens 152 having the same or different pore size. The pore size is normally selected based on the anticipated particle size to be filtered from the liquid.

The filter element 150 defines a drain channel 164 that fluidly connects the wash chamber 114 with the drain inlet 134. Soil that does not pass through the filter screen 152 remains within the drain channel 164 where it can be removed through the drain inlet 134.

Liquid, and any soil particles that are smaller than the pore size of the filter screen 152, may flow from the wash chamber 114 into the drain channel 164, through the filter screen 152 and into a circulation channel 166. The circulation channel 166 is defined by the side wall of the filter element 150 and the side wall of the sump 124 and is fluidly connected with the circulation hose 142 through the circulation inlet 140.

The filter assembly 148 may also comprise a sequester in the form of an auger 162 for removing soil that may accumulate on the surface of the filter screen 152. The auger 162 may also provide a downward force to drive the soil towards the drain inlet 134. The auger 162 is disposed within the drain channel 164 and is rotatably connected with a drive shaft 170 that extends through the bottom of the sump 124 for providing rotation of the auger 162 relative to the filter element 150. The drive shaft 170 may be driven by a motor 172 located below the sump 124.

For purposes of the invention, relative rotation of the filter element 150 and the auger 162 is desired. While the relative rotation has been described in terms of the auger 162 rotation relative to the filter element 150, it with in the scope of the invention for both the filter element 150 and the auger 162 to rotate at different speeds and/or in counter directions. It is also within the scope of the invention for filter element 150 to rotate while the auger 162 is fixed.

The auger 162 may comprise a compliant material, such as a silicon sponge, for example along an exterior portion of the helical vane of the auger 162. The auger 162 is sized such that the exterior portion of the helical vane of the auger 162 is in contact with the surface of the filter screen 152. The drive shaft 170 drives the auger 162 causing it to rotate relative to the filter screen 152. As the auger 162 rotates, it removes any soil that may have accumulated on the filter screen 152 and drives it towards the bottom of the sump 124 where the drain inlet 134 is located. The auger 162 also provides a sequestration feature to hold the soil near the drain inlet 134 until it can be removed from the sump 124 by the drain circuit 128 during a drain cycle.

Figure 7:
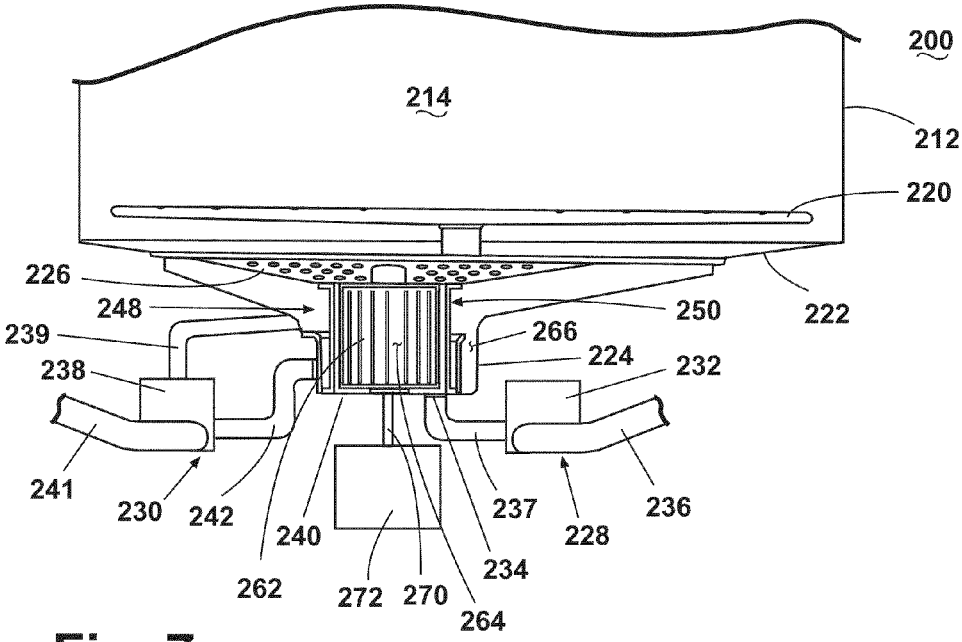
FIG. 7 is schematic of a dishwasher having a filter assembly comprising a scraper according to an embodiment of the invention.

FIG. 7 illustrates a dishwasher 200 according to another embodiment of the invention. The dishwasher 200 is similar to the dishwasher 100, therefore elements in the dishwasher 200 similar to those of dishwasher 100 will be numbered with the prefix 200.

As illustrated in FIG. 7, the dishwasher 200 comprises a tub 212 defining a wash chamber 214. The bottom 222 of the tub 212 may slope downwards towards a sump 224. The sump 224 may be covered by a grating 226.

The sump 224 may be fluidly connected with a drain circuit 228 for draining soil and liquid from the sump 224 and a circulation circuit 230 for circulating liquid from the sump 224 back to the wash chamber 214. The drain circuit 228 may comprise a drain inlet 234 fluidly connected with a drain hose 236 by a drain pump 232. When actuated, the drain pump 232 may draw soil and liquid from the sump 224 and into the drain hose 236 which may be fluidly coupled with a household drain (not shown).

The circulation circuit 230 may comprise a circulation inlet 240 fluidly connected with a first and second supply hose 239, 241 by a circulation pump 238. The first supply hose 239 may be connected with a lower sprayer at the bottom of the tub 212 for spraying water into the wash chamber 214. The second supply hose 241 may be fluidly coupled with one or more additional sprayers 220 located in the middle or at the top of the wash chamber 214 through a supply conduit that may extend up a side wall of the tub 212 (not shown). In this manner, the circulation pump 238 may be actuated to draw liquid from the sump 224 and supply it to the wash chamber 214 through one or more sprayers 220.

A filter assembly 248 comprising a cylindrical filter element 250 is located within the sump 224. The cylindrical filter element 250 extends from the bottom of the sump 224 to the grating 226 and separates the drain inlet 234 from the circulation inlet 240 in such a way that liquid entering the sump 224 from the wash chamber 214 is filtered by the filtering element 250 before it enters the circulation circuit 230. The sidewalls of the filter element 250 may comprise one or more filter screens 252. The filter screens 252 may be made from any suitable material and have any suitable pore size. One example of a suitable material is stainless steel. Each filter element 250 may also comprise multiple filter screens 252 having the same or different pore size. The pore size is normally selected based on the anticipated particle size to be filtered from the liquid.

The filter element 250 may define a drain channel 264 that fluidly connects the wash chamber 214 with the drain inlet 234. Soil that does not pass through the filter screen 252 remains within the drain channel 264 where it can be removed through the drain inlet 234. Liquid, and any soil particles that are smaller than the pore size of the filter screen 252, may flow from the wash chamber 214 into the drain channel 264, through the filter screen 252 and into a circulation channel 266. The circulation channel 266 may be defined by the side wall of the filter element 250 and the side wall of the sump 224 and may be fluidly connected with the circulation hose 242 through the circulation inlet 240.

Figure 8:
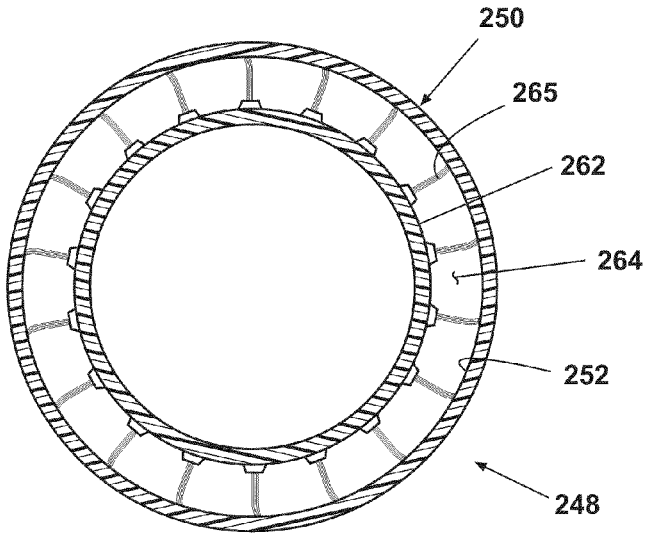
FIG. 8 is a top-down view of the filter assembly of FIG. 7 according to an embodiment of the invention.

Referring now to FIG. 8, the filter assembly 248 may also comprise a sequester in the form of an annular scraper 262 for removing soil that may accumulate on the surface of the filter screen 252 and driving the soil towards the drain inlet 234. The annular scraper 262 may be disposed within the drain channel 264 and rotatably connected with a drive shaft 270 that extends through the bottom of the sump 224 for providing rotation of the scraper 262 relative to the filter element 250. The drive shaft 270 may be driven by a motor 272 located below the sump 224.

For purposes of the invention, relative rotation of the filter element 250 and the auger 262 is desired. While the relative rotation has been described in terms of the auger 262 rotation relative to the filter element 250, it with in the scope of the invention for both the filter element 250 and the auger 262 to rotate at different speeds and/or in counter directions. It is also within the scope of the invention for filter element 250 to rotate while the auger 262 is fixed.

The annular scraper 262 may comprise compliant blades or brushes 265 that engage the surface of the filter screen 252 to remove any soil that may have accumulated on the filter screen 252. The annular scraper 262 is substantially open at the top and the bottom so that soil may flow unobstructed from the wash chamber 214 to the drain inlet 234 located at the bottom of the sump. The soil may be removed from the sump 124 by the drain circuit 128 during a drain cycle.

While the invention has been described in the context of a vertically arranged sump and filter assembly, it is not limited to a vertically arranged assembly. It is within the scope of the invention according to any of the embodiments for the sump and filter assembly to be horizontally arranged or set at any angle between a vertical and horizontal plane.

While the invention has been described in connection with certain specific embodiments thereof, it may be understood that this is by way of illustration and not of limitation and the scope of the appended claims should be construed as broadly as the prior art will permit.

What is claimed is:

1. A dishwasher for washing utensil with liquid, comprising:

a tub defining a wash chamber in which utensils are received for washing and having a sump;

a circulation circuit having a circulation inlet fluidly coupling the sump to the wash chamber to circulate liquid from the sump to the wash chamber;

a drain circuit having a drain inlet fluidly coupled to the sump to drain liquid;

a filter located within the sump and having multiple filter elements separated by interstitial spaces in communication with the drain inlet, with each filter element having an open portion in communication with the circulation inlet, such that liquid passing from the sump to the circulation circuit passes through at least one of the multiple filter elements and particles not passing through the multiple filter elements remain in the interstitial spaces on a side of each filter element adjacent the drain inlet; and a sequester located within the interstitial spaces and adjacent at least one of the multiple filter elements to sequester the particles remaining in the interstitial spaces near the drain inlet.

2. The dishwasher of claim 1 wherein the sequester comprises a deflector configured to direct the particles toward the drain inlet.

3. The dishwasher of claim 2 wherein the deflector extends from at least one of the multiple filter elements to the drain inlet.

4. The dishwasher of claim 3 wherein at least one of the deflector and filter rotate to bring the particles into contact with the deflector and drive them along the deflector toward the drain inlet.

5. The dishwasher of claim 1 wherein at least one of the sequester and filter rotate to drive the particles to the drain inlet and hold the particles at the drain inlet.

6. The dishwasher of claim 1 wherein the multiple filter elements form multiple channels separated by the interstitial spaces in communication with the drain inlet, with each channel having an open portion in communication with the circulation inlet.

7. The dishwasher of claim 6 wherein the multiple filter elements form multiple, circular channels, which are concentrically arranged.

8. The dishwasher of claim 7 wherein the filter rotates relative to the sump.

9. The dishwasher of claim 1 wherein the multiple filter elements are concentrically arranged.

* * * * *